US007784318B2

(12) United States Patent
Krintzline et al.

(10) Patent No.: US 7,784,318 B2
(45) Date of Patent: Aug. 31, 2010

(54) TURNED BLANK MONITOR

(75) Inventors: Donald E. Krintzline, Tiffin, OH (US); Laurence W. Kelbley, Tiffin, OH (US); Thomas E. Hay, Tiffin, OH (US)

(73) Assignee: National Machinery LLC, Tiffin, OH (US)

( * ) Notice: Subject to any disclaimer, the term of this patent is extended or adjusted under 35 U.S.C. 154(b) by 344 days.

(21) Appl. No.: 12/056,453

(22) Filed: Mar. 27, 2008

(65) Prior Publication Data

US 2009/0241625 A1 Oct. 1, 2009

(51) Int. Cl.

| | |
|---|---|
| ***B30B 15/14*** | (2006.01) |
| ***B21D 55/00*** | (2006.01) |
| ***B21B 37/00*** | (2006.01) |
| *B21D 43/05* | (2006.01) |
| *B21J 13/10* | (2006.01) |

(52) U.S. Cl. ..... 72/21.3; 72/18.9; 72/19.4; 72/21.4; 72/31.11; 72/441; 72/446; 72/452.5; 100/282; 100/283

(58) Field of Classification Search ..... 100/49, 100/257, 282, 283, 289; 72/4, 17.3, 18.9, 72/19.4, 21.1, 21.3, 21.4, 31.11, 441, 446, 72/452.5

See application file for complete search history.

(56) References Cited

U.S. PATENT DOCUMENTS

| | | | | |
|---|---|---|---|---|
| 4,202,191 A * | 5/1980 | Skinner | ..... | 72/17.3 |
| 4,317,354 A * | 3/1982 | Wisebaker | ..... | 72/339 |
| 4,763,501 A * | 8/1988 | Massariolo | ..... | 72/21.3 |
| 4,918,956 A * | 4/1990 | Schoch | ..... | 72/21.1 |
| 4,966,028 A * | 10/1990 | Sakamura et al. | ..... | 72/361 |
| 5,000,021 A * | 3/1991 | Nakamura et al. | ..... | 72/19.5 |
| 5,727,409 A * | 3/1998 | Inoue et al. | ..... | 72/21.1 |
| 5,921,125 A * | 7/1999 | Inoue et al. | ..... | 72/20.2 |
| 6,272,892 B1 * | 8/2001 | Ozaki et al. | ..... | 72/21.3 |
| 6,871,586 B2 * | 3/2005 | Teraoka | ..... | 100/282 |

* cited by examiner

*Primary Examiner*—David B Jones
(74) *Attorney, Agent, or Firm*—Pearne & Gordon LLP

(57) ABSTRACT

A method and apparatus for detecting a turned blank at a workstation in a progressive forging machine comprising simultaneously monitoring both the force on a tool in the workstation and the crank angle of the machine, determining a reference crank angle when the tool is subjected to a force at the workstation about to deliver a blow and a blank in the workstation is properly angularly aligned, operating the machine to forge blanks in a normal manner when a force on the tool at the workstation occurs substantially at the reference crank angle, and interrupting said normal manner when the force on the tool at the workstation occurs before said reference crankshaft angle to enable the blank being formed at the workstation to be separated from remaining blanks being forged in the machine.

6 Claims, 4 Drawing Sheets

TURNED BLANK MONITOR

The invention relates to improvements in progressive forming machines and, in particular, apparatus for detecting angularly misaligned blanks at a workstation in which they are to be additionally formed.

BACKGROUND OF THE INVENTION

Progressive forming machines typically shape a piece of round wire, hereinafter sometimes called a blank, into a desired shape by striking it with tools and forcing it into dies having configurations corresponding to intermediate and finally shaped blanks or parts. Depending on the character of the part, this forging process can involve separate forging blows performed at multiple successive work stations. Hex head or twelve point head bolts are examples of parts commonly produced in progressive forging machines that can suffer when a blank turns even slightly on its longitudinal axis when it is transferred from one work or forming station to another. Where the blank has a profile that is not both circular and concentric with its axis, rotation of the blank about its longitudinal axis can introduce enough misalignment to prevent the blank from being properly received and formed in a succeeding workstation. This unintended turning, even if relatively small, can result in a misshapen part.

In a high production application, particularly where the unwanted turning of a blank occurs randomly and intermittently, a defective finished part may not be detected by the manufacturer. However, even a small number of defective parts mixed in with a large batch of good parts can cause significant problems for the ultimate user of the part. It can be expected that these problems and their associated costs will ultimately be traced back to the manufacturer resulting in customer dissatisfaction as well as ultimate financial loss to the manufacturer that far exceeds the value of the defective part.

SUMMARY OF THE INVENTION

The invention provides a system to detect accidentally turned blanks at one or more workstations of a progressive forging machine. The system utilizes the inherent "go, no go" nature of the blank and tooling at the relevant station. Where the blank is properly aligned with the tooling in an angular sense, the blank will be smoothly received in the tooling. To the extent that the blank is angularly misaligned through accidental turning during the transfer process from station to station, it will resist entering the tooling. The system detects resistance of the blank in entering the tooling and interrupts regular operation of the machine to permit the misaligned blank to be removed from the stream of good product.

In the preferred embodiment of the invention, misalignment between an inadvertently rotated blank at a particular work station is sensed by allowing the tooling to be displaced into its holder in response to forces imposed by the blank on the tool. Displacement, i.e. sliding, of the tool is detected by a proximity sensor which in turn communicates with the machine controller that can shut down the machine operation while the turned blank is removed manually or otherwise.

DESCRIPTION OF THE PREFERRED EMBODIMENT

Figure 1:
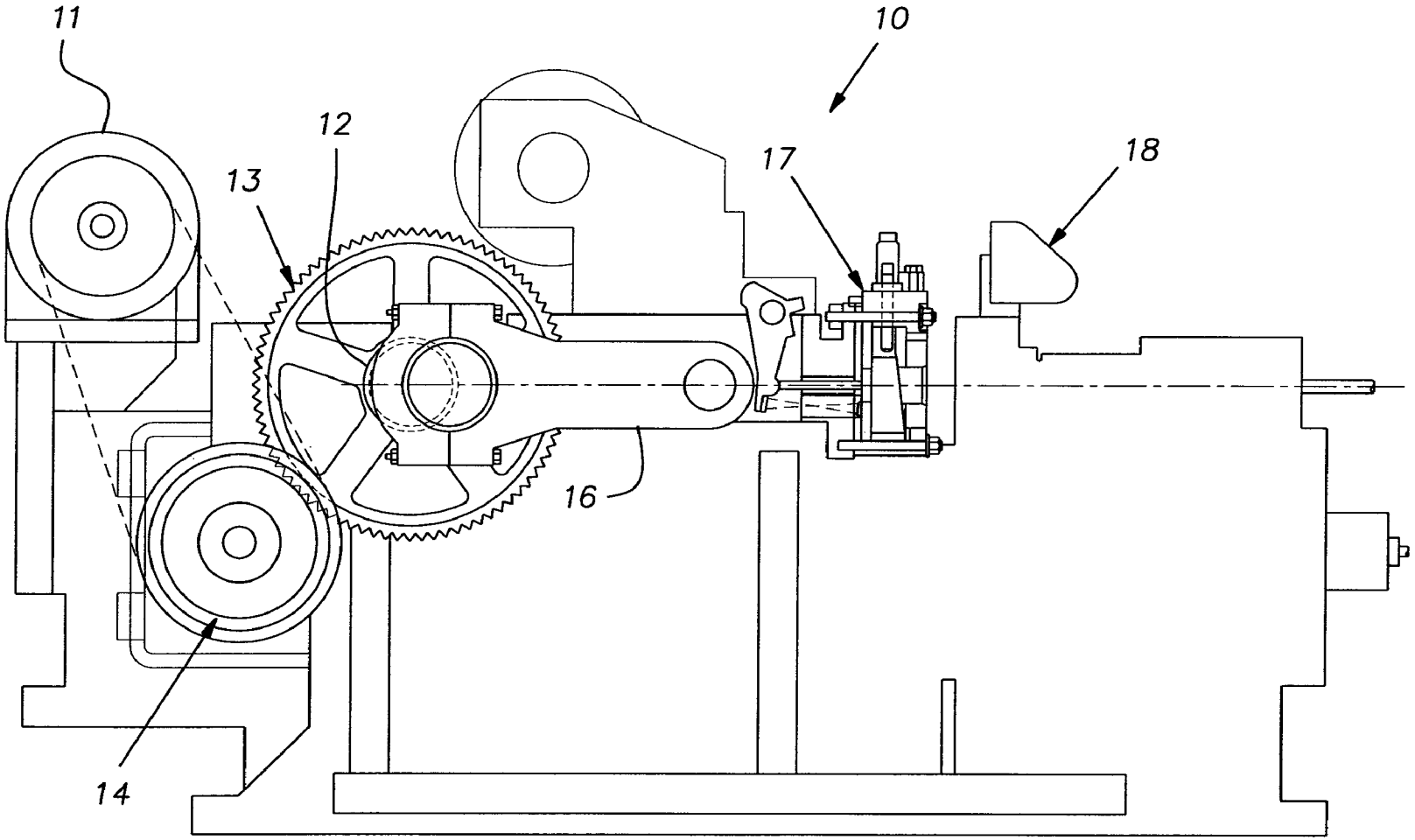
FIG. 1 is a diagrammatic side view of a multi-station forging machine in which the present invention is implemented.
Figure 2:
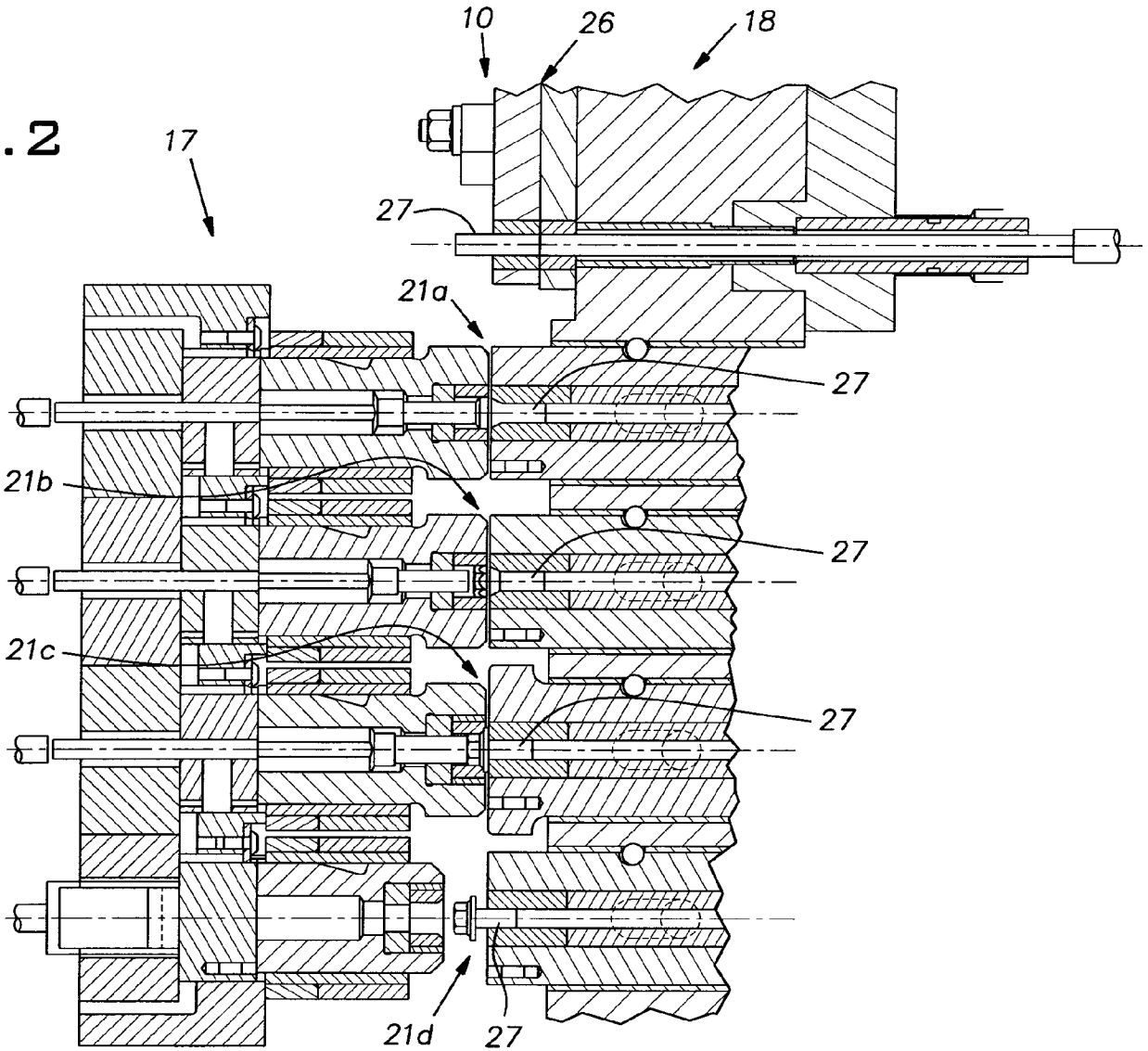
FIG. 2 is a diagrammatic plan view of the forging machine of FIG. 1.

Referring now to FIGS. 1 and 2, there is shown in side elevation and plan view, respectively, a progressive multi-stage forging machine 10 of generally conventional construction. An example of such a machine is shown in U.S. Pat. No. 4,898,017, the disclosure of which is incorporated herein by reference. The machine 10 is powered by an electric motor 11 that rotates a crankshaft 12 through a gear train indicated generally at 13 which is driven under the control of a clutch and brake assembly 14. Rotation of the crankshaft 12, through operation of a connecting rod 16, causes a slide or ram 17 to reciprocate towards and away from a stationary die breast 18 as is understood by those skilled in the art. Each revolution of the crankshaft 12 causes the machine 10 to perform a forming cycle. The die breast 18 and slide 17 have a plurality of aligned tool mounting locations representing successive workstations 21*a* through 21*d* uniformly spaced in a common horizontal plane.

Precise lengths of cylindrical wire stock, i.e. blanks 27, are formed at a cutoff station 26 and from this station are transferred to successive workstations 21*a*-21*d* during a part of each machine cycle. A mechanical transfer device (not shown) known in the art, moves each blank 27 during this transfer movement from one station 21 to the next succeeding station 21. Generally, a blank 27 being moved sequentially from station to station, has a cylindrical portion which is grasped by the fingers of the transfer mechanism. Typically, a forging machine is capable of producing forged parts of a wide variety of configurations. Frequently, these blanks or parts have areas with cross-sections that are not round and/or are not concentric about their longitudinal axis. For purposes of explanation, the longitudinal axis of a blank will ordinarily be understood to be the same as the central axis of its original cylindrical wire shape. There are frequently production jobs where it is important that the profile geometry of an accircular and/or eccentric blank, once formed in one station stay angularly aligned with the tooling in a subsequent station so that properly and accurately shaped parts can be reliably produced. Common examples of such parts are hex head and twelve point head bolts. From time to time, slippage or other mishandling of a blank 27 may occur during transfer of a blank from one station to the next and such slippage can involve some degree of turning, i.e. rotation of the blank about its longitudinal axis. Where the cross-sectional shape of a blank is not angularly aligned with the geometry of a subsequent tool, a misshapen or otherwise defective part is likely to be produced. It is therefore a desired goal of the present invention to detect such turned blanks so they can be separated from the product stream of good parts.

Figure 3A:
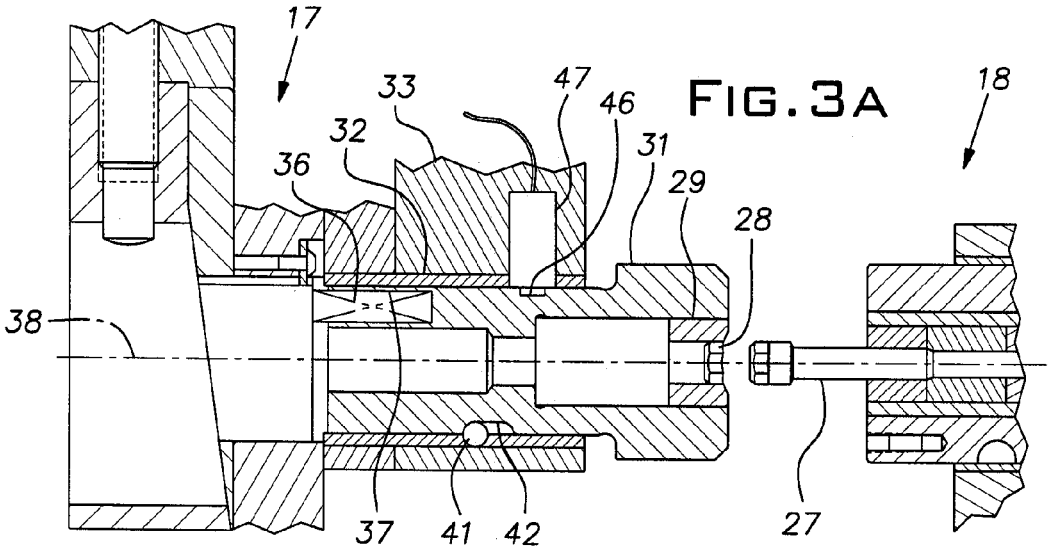
FIG. 3A is a fragmentary diagrammatic cross-sectional view of the machine taken at a vertical plane through the center of a workstation monitored for turned blanks in accordance with the invention.
Figure 3B:
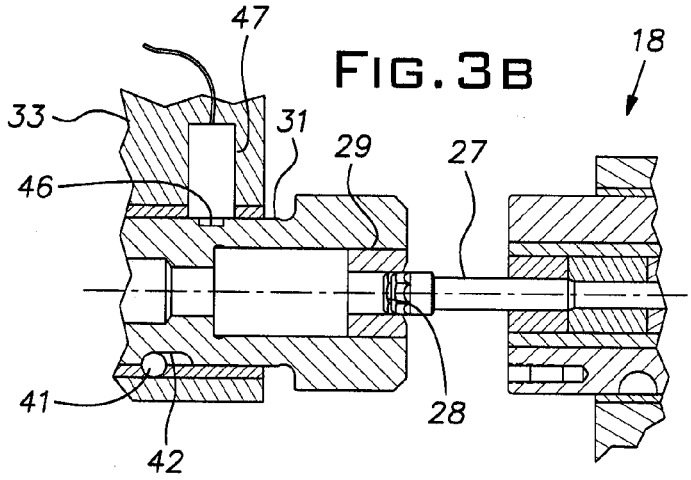
FIG. 3B is a fragmentary view similar to FIG. 3A showing a blank with a polygonal cross-section properly oriented and inserted into a tool cavity of complementary shape.
Figure 3C:
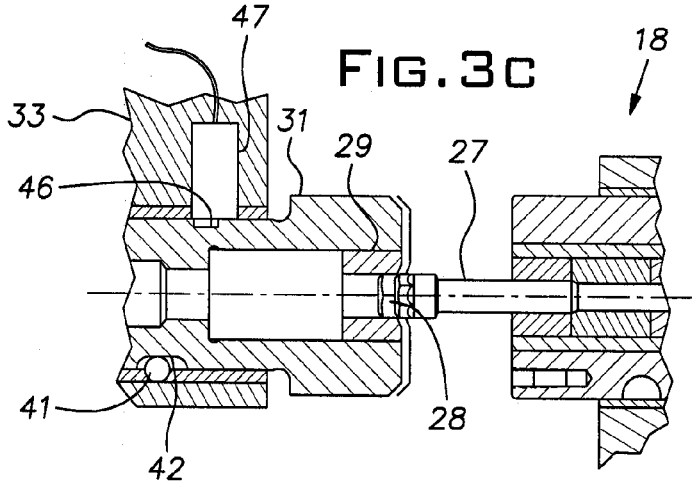
FIG. 3C is a fragmentary view similar to FIGS. 3A and 3B, but showing the blank in a condition where, because it has inadvertently turned, such as may occur in an imperfect transfer, it resists insertion into the complementarily shaped tool cavity.

The invention detects turned blanks 27 at a workstation such as the workstation 21*c* depicted in FIGS. 3A-3C by sensing a force resisting entry of a blank 27 into a cavity 28 of a tool 29. This resistance occurs because a blank 27 being inadvertently turned does not freely slide into the cavity 28. With reference to FIGS. 3A-3C, a case 31 carrying the tool 29 is slidably supported in a bushing fixed in a tool holder 33 on the slide 17. Compression springs 36 are carried in respective blind bores 37 in the case 31. The bores 37 and springs 36 are parallel to a central axis 38 of the workstation 21*c*. The springs 36 are proportioned to be compressed between a plate 39 on which the holder 33 is mounted and the end of the bores 37 so that the springs 36 bias the case 31 forwardly towards the die breast 18. A cross pin 41 fixed in the tool holder 33 is received in a tangential slot 42 in the wall of the case 31 and allows the case to move axially a limited distance corresponding to the width of the slot. The tool cavity 28 has an internal cross-section that is complementary to the external cross-section of the adjacent end of the blank 27 as it is presented to the workstation 21*c*. In the illustrated case, this cross-section is hexagonal, a form characteristic of a machine bolt and the result of a forming blow made in a preceding workstation 27*b*. In this station 21*c*, the blank 27 is to be further formed while its hex shape is precisely confined by the tool cavity 28. For example, it may be desired to form a flange on the head of the blank 27 at the underside of the hex head.

FIG. 3A illustrates the slide 17 in a position approaching but spaced from front dead center, i.e. its position closest to the die breast 18. In FIG. 3A, the springs 36 bias the case 31 and, therefore, the tool 29, to a forward position limited by bottoming of the pin 41 against one side of the tangential slot 42. In FIG. 3B, the slide 17 has moved close to the die breast 18, although it is not yet at front dead center. It will be seen that the blank 27 has smoothly entered the tool cavity 28, a result of being properly angularly oriented with respect to its longitudinal axis with the tool cavity. From this position of FIG. 3B, the slide 17 can complete its stroke and the blank will be properly formed at this station. In FIG. 3C, the blank is not properly angularly aligned with the tool cavity 28 and it will be seen by comparing this figure with that of FIG. 3B that the slide 17 has advanced to the same position as it is shown in FIG. 3B. The misalignment of the blank 27 with the cavity 28, however, prevents the blank from smoothly entering the cavity in a manner analogous to a "go, no go" gauge. The physical interference of the blank 27 and the tool 29 causes the tool and the case 31 in which it is fixed to retract against the force of the springs 36 relative to the holder 33.

A local flat or groove 46 on the case 31 is sensed by a proximity sensor 47 fixed in the holder 33 so that movement of the tool 29 and case 31 in the holder 33 results in a change in a signal from the proximity sensor 47. That is to say, the proximity sensor 47 can detect movement of the tool 29 from the position illustrated in FIGS. 3A and 3B to the position illustrated in FIG. 3C relative to the holder 33.

Operation of the machine 10 can be controlled by a programmable logic controller (PLC) 51 (FIG. 4) known in the art. In a customary manner, after the machine 10 has completed a number of start-up cycles, the machine finishes a blank 27 each time the crankshaft 12 makes a complete revolution. Various functions of the machine are timed by cams and other instrumentalities tied mechanically or electronically to the crankshaft 12. In the present arrangement, the angular position of the crankshaft 12 going from 0° to 360° is monitored by a programmable rotary limit switch 52 known in the art. A resolver (not shown) signals the programmable rotary limit switch 52 of the precise angular position of the crankshaft 12. When the machine 10 is set up for a production run of blanks different in configuration from a preceding run, and the turned blank monitoring feature of the present invention is to be used, the machine 10 can be run through a sufficient number of cycles to bring a blank 27 to the workstation 21*c* fitted with the proximity switch or sensor 47. Assuming that the blank 27 is properly angularly aligned with the tool cavity 28, the programmable rotary limit switch 52 can record the precise angle of the crankshaft 12 at which the tool 29 and case 31 are forced rearwardly in the tool holder 33 during a normal machine cycle. Thereafter, when full operation is initiated, the PLC 51, working with the programmable rotary limit switch 52 can monitor or check for turned blanks 27 by determining that the blank 27 has prematurely caused displacement of the tool 29 and case 31 in the holder 33. This can be done in accordance with the invention by relying on the turned blank 27 to not easily enter the complementarily shaped but not aligned tool cavity 28. Interference between the blank 27 and tool 29, owing to their angular misalignment, will result in the tool case 31 being displaced at an advanced point in the machine cycle, in particular, at an advanced angle of the crankshaft 12, i.e. at an angle of displacement less than the angular displacement of the crankshaft 12 corresponding to FIG. 3B.

The machine 10 is thus controlled to interrupt the flow of regular production blanks 27 when the proximity switch or sensor 47 senses this premature or advanced displacement of the tool 29 and case 31, measured by reference to the crankshaft angle. This control strategy is implemented, by way of example, with a hardwired logic circuit schematically shown in FIG. 4.

Once the coil of a relay 54 is turned on, its own contact closes and maintains the coil energized as long as either of relay contacts 56 or 57 are closed. The relay 56 is controlled by the proximity sensor 47 and the relay 57 is controlled by the programmable rotary limit switch 52. In order to initially energize relay 54, a momentary reset signal is applied to the coil of the relay via a push button switch 55. Once the relay 54 is "latched in" through its own contact and either relay 56 or 57 remain energized, a "no fault" signal remains applied to the PLC input (the PLC 51 monitors for the absence of a signal to determine that a fault or turned blank condition has occurred).

The programmable rotary limit switch 52 and associated relay 57 hold the turned blank fault indicator relay 54 energized during a time period or portion of a machine cycle that the tool case 31 is ordinarily displaced by proper engagement of a blank 27 in the tool 29. The relay 57 serves to maintain the fault indicating relay 54 on, i.e. latched in at this portion of a machine cycle. In contrast, the programmable rotary limit switch 52 turns off the relay 57 for a time period or segment of a machine cycle before normal displacement of the tool case 31 and the normal turn off of the related relay 56 to thereby create a check window and detect premature actuation of the proximity sensor 47, assumed to be the result of a turned blank.

As soon as neither relay 56 or 57 is energized, the power to the coil of relay 54 is removed and this relay de-energizes which action also opens its own contact. At the same time, the signal to the PLC 51 disappears which condition the PLC recognizes as a sensed turned blank (TBM fault) and the crankshaft 12 is stopped by the PLC with a signal to the clutch brake 14. In the process of stopping the crankshaft 12, even if either relay 56 or 57 are re-energized, relay 54 will not latch in again until a momentary signal is again reapplied to its coil via the reset push button 55.

Figure 4:
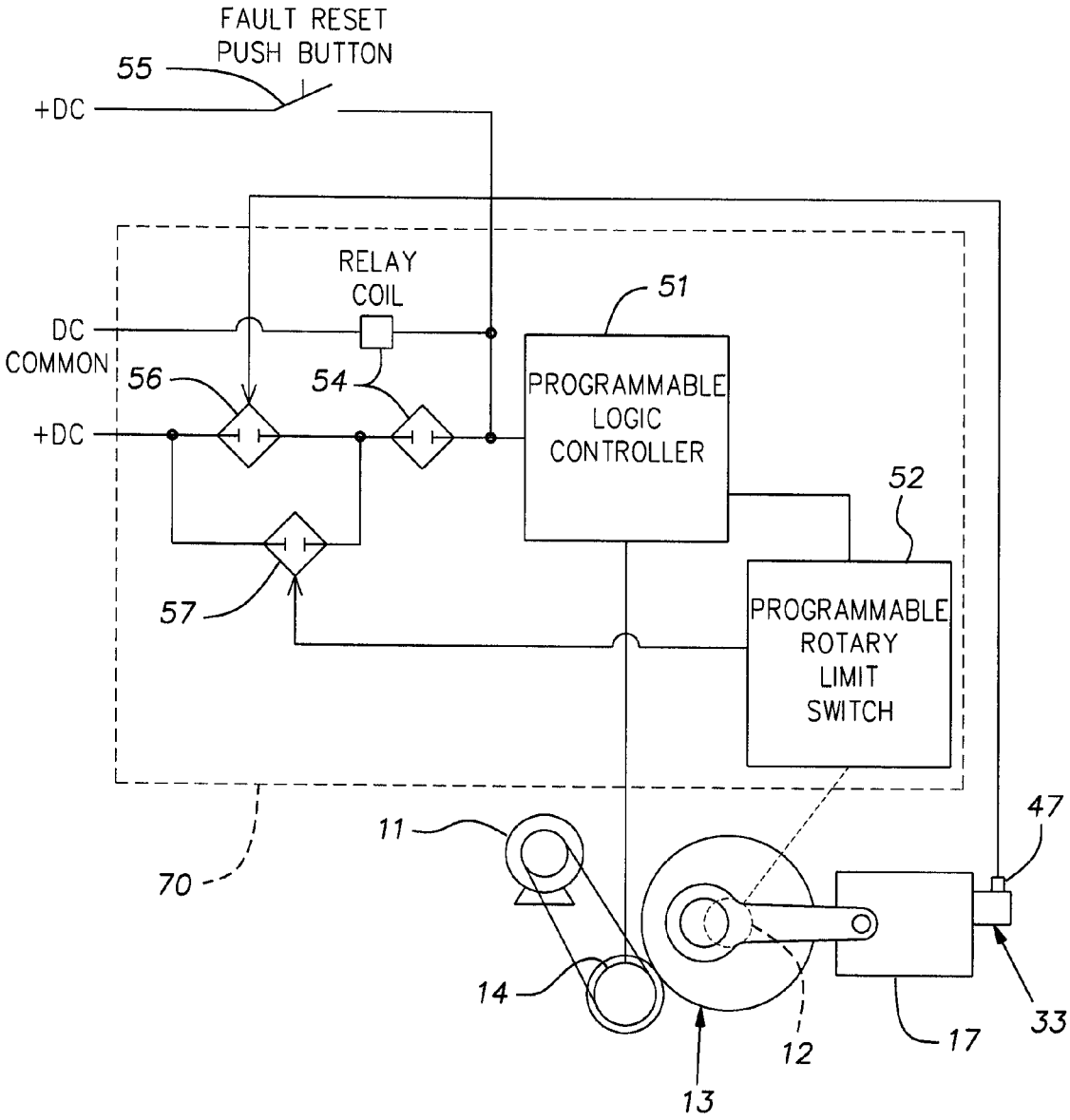
FIG. 4 is a diagrammatic circuit showing various components of one form of control circuitry for the machine of FIGS. 1 and 2.

A dashed outline 70 on FIG. 4 encompasses the major system components that include the relay logic elements 54, 56, and 57, the PLC 51, and the programmable rotary limit switch 52. It is feasible for all three of these elements to be integrated into a common programmable device capable of handling all the control tasks within the necessary throughput time restraints. The same functions performed by these elements can be handled in the same basic way, only with more software and less hardware control.

While, as disclosed, the crankshaft 12 can be stopped from cycling by the PLC 51 in the event that a turned blank fault signal is generated by a shut off of the relay 54 to enable a machine operator to manually retrieve the turned blank from the product stream, it is envisioned that the turned blank can be automatically retrieved after it is ejected from the machine and, in fact, with appropriate controls the turned blank could be withdrawn from the product stream of good parts without stopping the crankshaft 12.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of detecting a turned blank at a workstation in a progressive forging machine comprising simultaneously monitoring both the force on a tool in the workstation and the crank angle of the machine, determining a reference crank angle when the tool is subjected to a force at the workstation about to deliver a blow and a blank in the workstation is properly angularly aligned, operating the machine to forge blanks in a normal manner when a force on the tool at the workstation occurs substantially at the reference crank angle, and interrupting said normal manner when the force on the tool at the workstation occurs before said reference crankshaft angle to enable the blank being formed at the workstation to be separated from remaining blanks being forged in the machine.

2. A method as set forth in claim 1, wherein the tool at the workstation is slidably mounted in the machine for limited movement relative to the slide and a spring is provided to bias the tool against such limited movement in an axial direction, a force on the tool resulting from a turned blank resulting in sliding displacement of the tool and stressing of said spring.

3. A progressive forging machine having a die breast and a slide, the die breast and slide having a plurality of successive workstations, a rotatable crankshaft for forcibly reciprocating the slide towards and away from the die breast, the die breast and slide carrying tools for forming a blank at a monitored one of the workstations, one of the tools having a configuration complementary to a cross-section of a blank formed in a preceding station that is accircular and/or eccentric with respect to its longitudinal axis, a sensor at the monitored station for sensing forces on the tool developed by the slide when the slide is advancing in a blow towards the die breast, a device for establishing the reference angle of the crank at which a force is developed on the tool by advance of the slide when a blank being formed at the monitored workstation is angularly aligned with the tooling at the monitored station, a device capable of monitoring the crankshaft angle during operation of the machine and capable of generating a fault signal when a blank transferred to the monitored station is accidentally turned from an orientation angularly aligned with the tool at the monitored station to an angularly misaligned orientation whereby interference exists prematurely between the blank and the tool and a signal from the sensor as manifested by the force developed by advance of the slide occurs at a crank angle earlier than the reference crank angle.

4. A machine as set forth in claim 3, wherein the sensing device is a proximity sensor sensing motion of the tool relative to a holder therefore fixedly mounted on the slide.

5. A progressive forging machine as set forth in claim 3, wherein said tool is spring biased towards said die breast.

6. A progressive forging machine as set forth in claim 3, including a programmable rotary limit switch electronically coupled to monitor the angular position of said crankshaft.

* * * * *